United States Patent [19]

Standing

[11] 4,085,390

[45] Apr. 18, 1978

[54] SYMMETRICAL STRIPLINE PACKAGE

[75] Inventor: Arthur Frederick Standing, Rockville, Md.

[73] Assignee: Communications Satellite Corporation, Washington, D.C.

[21] Appl. No.: 831,826

[22] Filed: Sep. 9, 1977

Related U.S. Application Data

[63] Continuation-in-part of Ser. No. 661,596, Feb. 26, 1976, abandoned.

[51] Int. Cl.[2] ..... H01P 3/08; H01P 5/08

[52] U.S. Cl. ..... 333/33; 333/31 R; 333/84 M

[58] Field of Search ..... 333/31 R, 33, 84 M

[56] References Cited

U.S. PATENT DOCUMENTS

| | | | |
|---|---|---|---|
| 3,135,935 | 6/1974 | Engelbrecht | 333/84 M |
| 3,868,594 | 2/1975 | Cornwell et al. | 333/84 M X |

OTHER PUBLICATIONS

Gonda, *Transmission Line Couplers,* IBM Tech. Discl. Bulletin, vol. 4, No. 12, May 1962.

Bland et al., *Coax to Stripline Transition,* IBM Tech. Discl. Bulletin, vol. 3, No. 4. Sept. 1960.

*Primary Examiner*—Paul L. Gensler

*Attorney, Agent, or Firm*—Sughrue, Rothwell, Mion, Zinn and Macpeak

[57] ABSTRACT

A microwave stripline package provides symmetrical ground currents while permitting discrete components such as diodes, terminations, capacitors, etc.to be used. The package comprises a pair of face-to-face printed circuit boards, each of which is formed of a dielectric having a ground plane on one surface. The discrete components together with a printed circuit are assembled on one of the boards while a portion of the dielectric of the other board is cut away to provide mechanical clearance for the circuit components. Matching portions of the dielectrics on either side of the printed circuit are cut away to receive a pair of metal blocks which contact both the upper and lower ground planes in order to form a screened enclosure. The dimensions of the printed circuit within the screened enclosure are selected to provide impedance matching with the stripline outside the enclosure.

12 Claims, 2 Drawing Figures

SYMMETRICAL STRIPLINE PACKAGE

BACKGROUND OF THE INVENTION

This application is a continuation-in-part of my prior application, Ser. No. 661,596 filed Feb. 26, 1976 entitled "A Symmetrical Stripline Package," now abandoned.

The present invention generally relates to microwave circuits and components, and more particularly to a microwave package which provides symmetrical ground currents while permitting discrete components to be used in symmetrical transmission lines, i.e., striplines. A symmetrical transmission line is defined as a transmission line having a symmetrical electric field distribution about its conductor. Thus, a stripline, composed of a center conductor embedded in a uniform dielectric equidistant from a pair of ground planes, is a symmetrical transmission line since the electric field distribution is symmetrical on opposite sides of the conductor. In contrast, a microstrip consists of a conductor suspended above a single ground plane and, therefore, the electric field distributions above and below the microstrip conductor are not symmetrical. Thus, a microstrip represents an "asymmetrical" transmission line.

It is often desirable to use discrete electrical components e.g., diodes, terminations, capacitors, etc., in microwave stripline circuits, but to do so normally produces unwanted radial (pill box) modes. These radial modes originate at points of nonuniformity in the electric field distribution and propagate radially between the ground planes, thus resulting in power loss and interferring with the desired signal. This phenomenon can be more clearly understood in the following example. In a simple stripline, the electric field distribution on one side of the conductor is cancelled at all points within the stripline by a symmetrical but opposed electric field distribution on the opposite side of the conductor. Thus, the net electric field is zero and no radial mode occurs. However, if a diode were to be connected between the center conductor and one of the ground planes, the electric field distributions on either side of the conductor would become asymmetrical, thus resulting in a net electric field between opposite sides of the center conductor which would propagate between the ground planes.

One method of providing symmetrical ground return currents and, therefore, maintaining a symmetrical electric field distribution is to connect the components in pairs. In the example given above, it would merely be necessary to connect a second diode between the center conductor and the other ground plane immediately opposite the first diode. Although this represents a quite simple solution for maintaining the electric field symmetry of the stripline, it is unsatisfactory since it results in the expensive duplication of components.

Another known method of dealing with these radial modes is to surround the area of electric field nonuniformity by a series of mode suppressor screws which connect both ground planes. At lower frequencies the screws may be considered close together and, therefore, they represent an effective enclosure. However, at higher frequencies, these screws become less effective and considerable field leakage may occur between screws. Increasing the effectiveness of the mode suppressor screws by increasing their number and decreasing their spacing, is often not a viable alternative due to the small size of the stripline.

Another solution for containing the radial modes is to use a separate screened enclosure containing the desired discrete components but this results in unacceptable impedance matching problems at the stripline-enclosure interface. Moreover, fabrication and assembly of the components in the enclosure is difficult due to the small size of the package and the mechanical interference of the enclosure walls during the assembly process.

SUMMARY OF THE INVENTION

The present invention overcomes the problems heretofore encountered in controlling the radial modes generated by the use of discrete components in otherwise symmetrical microwave striplines. The invention accomplishes this by providing a screened enclosure from a pair of face-to-face printed circuit boards and cooperating metal blocks. A printed circuit together with the desired discrete components are mounted on the dielectric surface of one of the boards while a matching portion of the dielectric on the other board is cut away to provide mechanical clearance for the components. Matching portions of the dielectric on either side of the printed circuit are cut away to expose the upper and lower ground planes. The metal blocks contact both ground planes and in conjunction therewith form the screened enclosure. The spacing between the metal blocks and printed circuit is designed to provide impedance matching between the interior and exterior of the screened enclosure.

BRIEF DESCRIPTION OF THE DRAWINGS

The specific nature of the invention, as well as other objects, aspects, uses and advantages thereof, will clearly appear from the following description and from the accompanying drawing, in which.

DETAILED DESCRIPTION OF THE PREFERRED EMBODIMENT

Figure 1:
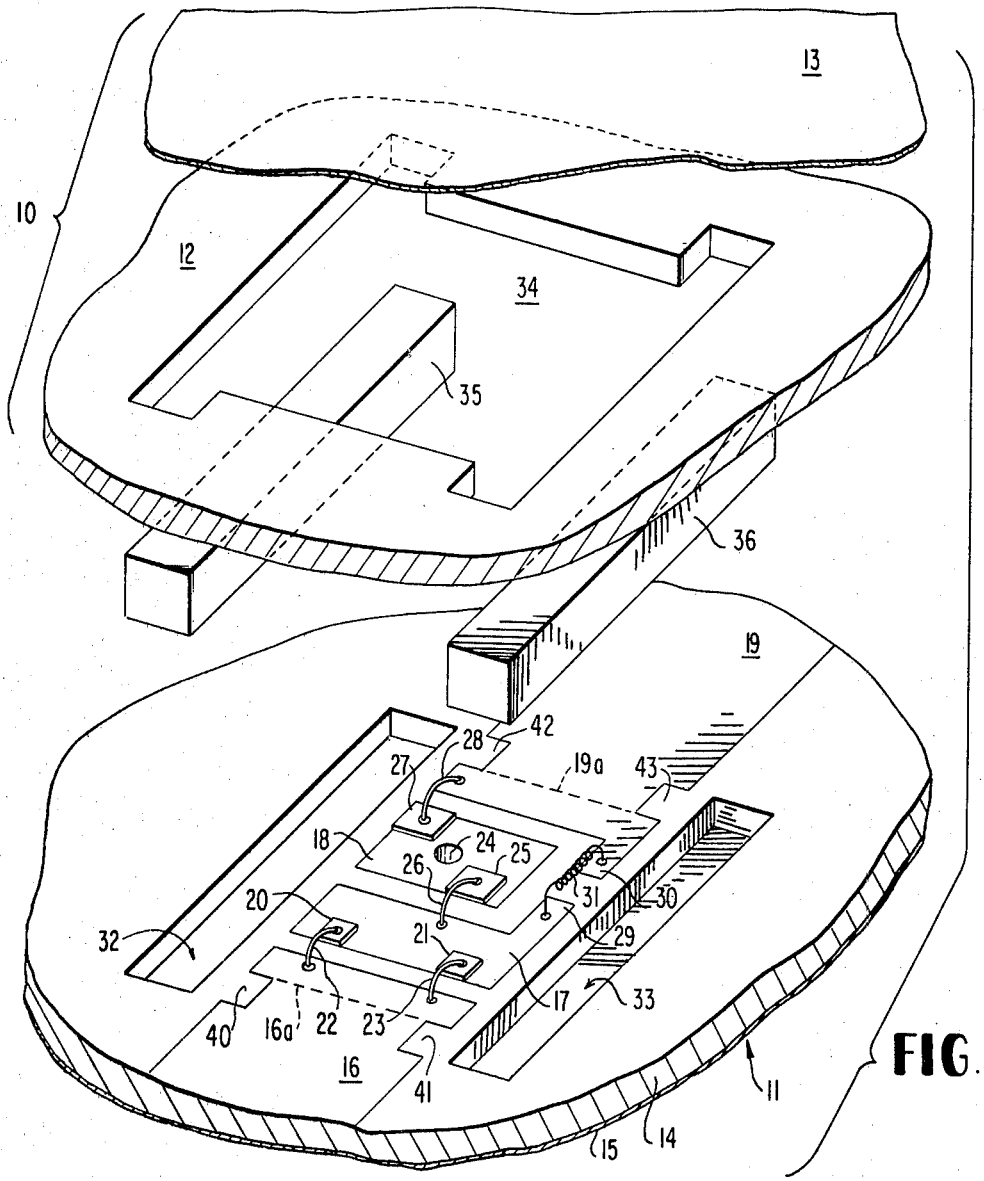
FIG. 1 is an exploded view illustrating the mechanical assembly of the preferred embodiment of the invention.

Referring now to FIG. 1, a preferred form of the invention is illustrated in the form of a stripline diode package which may be used, in conjunction with other microwave components such as hybrids and circulators, to form a phase shifter. The package comprises upper and lower printed circuit boards 10 and 11. The upper printed circuit board is formed of a dielectric 12 and an upper ground plane 13 while the lower printed circuit board includes a dielectric 14 and a lower ground plane 15. All of the printed circuitry for the package is formed on the upper surface of the dielectric 14. Specifically, the package includes printed circuit conductors 16 and 19 which form an RF input stripline and bias input stripline, respectively, a printed circuit conductor 18 which is connected to the lower ground plane 15 by means of a plated through hole 24, thereby forming a ground pad, and a printed circuit conductor 17 which, as will be described more fully below, forms a part of a microstrip circuit. The electrical components used in the stripline package include miniature capacitors 20 and 21 bonded to the conductor 17 and electrically connected to the end of conductor 16 by wire leads 22 and 23, respectively, which are bonded at one end to the conductor 16 and at the other end to the corresponding capacitor. A PIN diode 25 has either its cathode or anode bonded to the ground pad 18. A wire lead 26 is bonded at one end to the conductor 17 and at the other end to the remaining terminal of the diode 25. A capacitor 27 is also bonded to the ground pad 18 and is electrically connected to the conductor 19 by means of a wire lead 28 bonded at either end to the capacitor 27 and the conductor 19, respectively. Finally, aligned projections 29 and 30 on conductors 17 and 19, respectively, are electrically connected by means of a wound inductor 31 bonded at either end to the respective projections.

From the foregoing description, it will be appreciated that the printed circuit fabrication and electrical component mounting on the lower printed circuit board 11 is easily accomplished using known techniques. After the electrical components have been mounted as described above, a screened enclosure is formed by providing two slots, 32 and 33, cut into the dielectric 14 to expose the lower ground plane 15. The slots are located on either side and adjacent to the printed circuitry on the upper surface of the lower printed circuit board 11. The dielectric 12 of the upper printed circuit board 10 has a large aperture 34 cut therein to expose the ground plane 13. The peripheral walls of the aperture 34 are cut to be in mechanical registry with the outermost walls of the slots 32 and 33. Metal blocks 35 and 36 are inserted into slots 32 and 33, respectively, to contact the lower ground plane 15 and project above the dielectric 14 a distance which is equal to the thickness of the dielectric 12. The upper printed circuit board 10 is then placed over the lower printed circuit board assembly so that the metal blocks 35 and 36 project through the aperture 34 and make electrical contact with the upper ground plane 13. The aperture 34 in the area between the metal blocks 35 and 36 provides the required mechanical clearance for the electrical components, such as capacitors 20, 21 and 27, PIN diode 25 and inductor 31, mounted on the printed circuit board 11.

Although FIG. 1 illustrates the apertures in the printed circuit boards as not penetrating the ground planes, it would be appreciated that it is difficult to cut away all of the dielectric without penetrating the ground layer. Therefore, it may be preferable to cut away the ground planes as well as the dielectric and to then assure continuity of the ground planes by placing metallic plates over the apertures and fasten them to the package by means of suitable bolts through the metal blocks 35 and 36.

As will now be explained, the above-described package represents a microstrip circuit employing discrete electrical components and housed within a screened enclosure, and a smooth transistion between the microstrip circuitry within the screened enclosure and the stripline outside of the enclosure. It will be understood by one skilled in the art that the portions of the conductors 16 and 19 which do not lie between slots 32 and 33 form the center conductors of symmetrical microwave striplines since they are single conductors supported between a pair of ground planes 13 and 15 and surrounded by a uniform dielectric material, 12 and 14. The slots 32 and 33 are cut closely enough to the conductors 16 and 19 so that a significant amount of the electric field between those conductors and ground is supported by the metal blocks 35 and 36, respectively. Thus, the conductors 16 and 19 surrounded by dielectric material 12 and 14 form the center conductors of rectangular coax sections, the outer conductors of which are formed by metal blocks 35 and 36 in conjunction with upper and lower ground planes 13 and 15, respectively. The impedance of the rectangular coax sections is matched to that of the striplines by controlling the spacing between the center conductors 16 and 19 and the metal bars 35 and 36. Although this could be accomplished by moving the metal bars in or out as required, the simplest method is to etch away portions of the center conductors as shown at 40, 41, 42 and 43 in FIG. 1.

Due to the aperture 34 cut in the upper dielectric 12, there is no upper dielectric between dotted lines **16*a* and 19*a* in FIG. 1, and the printed circuitry lying between dotted lines 16*a* and 19*a* is, in effect, a microstrip circuit even though it is supported between upper and lower ground planes. This is due to the fact that the dielectric constant of the lower dielectric 14 is significantly greater than the dielectric constant of the air in the aperture 34 between the printed circuitry and the upper ground plane 13. Due to the large difference between the dielectric constants, and by maintaining a sufficient distance between the upper ground plane 13 and the printed circuitry, virtually all of the electric field will be concentrated in the lower dielectric 14. Thus, the portion of the microwave package between dotted lines 16*a* and 19*a* represents a microstrip circuit employing discrete electrical components and mounted within a screened enclosure defined by metal bars 35 and 36 and upper and lower ground planes 13 and 15, respectively. In order to provide a smooth impedance match between the rectangular coax sections and the microstrip circuitry the end portions of conductors 16 and 19 are extended outwardly toward the metal bars 35 and 36** in order to achieve the desired spacing therebetween. The particular conductor-bar spacing required to achieve a smooth impedance match with the rectangular coax sections would be a simple matter to one skilled in the art.

The above-described structure results in a screened package with a low impedance bias line capable of high speed switching. Radial modes which may be generated by the discrete electrical components and the asymmetrical microstrip circuitry between dotted lines **16*a* and 19*a* are blocked by metal bars 35 and 36. No field leakage is encountered as when mode suppressing screws are used. Radial modes propagating longitudinally through the package are attenuated in the rectangular coax sections which are incapable of supporting such modes. The length of the rectangular coax sections is purely a matter of design, longer coax sections providing greater attentuation of the radial modes occurring within the screened enclosure. The rectangular coax sections could be eliminated altogether, thereby providing virtually no isolation between the stripline and the microstrip circuitry within the screened enclosure, and although the performance of the package would suffer, it would still be operable due to the radial mode suppression within the screened enclosure achieved by the metal bars 35 and 36. In such a case, the dimensions of the conductors 16 and 19** would have to be controlled in order to provide a smooth impedance match from stripline-to-microstrip, rather than from stripline-to-rectangular coax-to-microstrip.

It should be noted here that although a waveguide is formed by the upper and lower ground planes and metal bars 35 and 36, the dimensions of the package are selected so that the waveguide formed thereby is incapable of supporting interferring signals at the frequencies in which the apparatus is to be operated.

Figure 2:
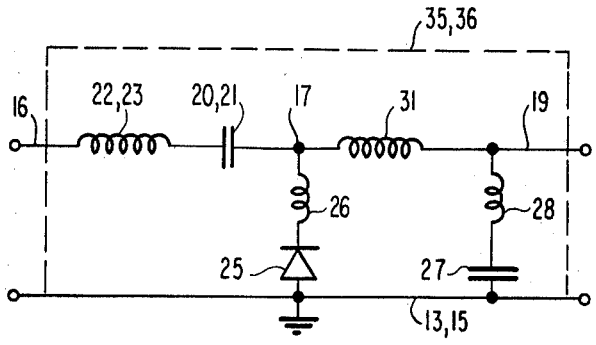
FIG. 2 is a schematic diagram of the equivalent circuit of the preferred embodiment illustrated in FIG. 1.

The electrical configuration of the preferred embodiment illustrated in FIG. 1 is shown in the schematic diagram of FIG. 2. In this figure, the same reference numerals used in FIG. 1 are used to designate like or corresponding components or elements. Specifically, the RF input stripline 16, via the retangular coax section, enters the screened enclosure formed by the ground planes 13 and 15 and the metal blocks 35 and 36 and is connected to a DC blocking capacitor 20,21 through a small inductance 22,23 formed by the bonding wires 22,23 in FIG. 1. The other terminal of the DC blocking capacitor 20,21 is connected to the node 17. A PIN diode is connected at its anode to ground 13,15 and its cathode is connected through an inductance 26 (formed by the corresponding bonding wire in FIG. 1) to the node 17. A bias decoupling inductor 31 is connected at one end to the node 17 and at the other end to the bias input conductor 19. Finally, a bias decoupling capacitor 27 is connected at one terminal to ground 13,15 and at its other terminal, through a very small inductance formed by the bonding wire 28, to the conductor 19.

The particular diode circuit illustrated in FIGS. 1 and 2 when used in combination with, for example, a hybrid junction or circulator provides a phase shift by reflection of the RF signal on stripline 16. The phase of the reflected signal is dependent upon the state of the PIN diode 25 which, in turn, is controlled by the bias signal, for example a video switching signal, on the stripline 19. When the PIN diode is conducting, the phase shift is due to the inductance 26, and when the PIN diode 25 is nonconducting, the phase shift is due to the junction capacitance of the diode.

While the invention has been specifically described in terms of a stripline diode package having RF input and bias input striplines, it will be apparent that this specific embodiment is only exemplary and that various modifications can be made in construction and arrangement within the scope of the invention as defined in the appended claims. For example, rather than providing the bias signal by means of stripline 19, it would be possible to provide the bias signal by means of a coaxial cable. In such a case, the stripline-to-rectangular coax transistion would be replaced by a coax-to-rectangular coax connection in which the coaxial cable extending perpendicularly through the upper ground plane 13 would have its outer conductor connected to the ground plane 13 and its center conductor extending through the dielectric 12 and connected to the printed circuit conductor 19 between the etched portions 42 and 43. In general, the invention may be characterized as a microwave package which provides symmetrical ground currents while permitting discrete electrical components to be used in stripline transmission lines.

What is claimed is:

1. A microwave package which provides symmetrical ground currents when discrete components are used in a stripline circuit, comprising:

a first printed circuit board formed of a first dielectric material and having a continuous first ground plane on one surface and a printed circuit on the opposite surface;

at least one discrete component electrically coupled to said printed circuit;

a second printed circuit board formed of a second dielectric material and having a continuous second ground plane on one surface a portion of said second dielectric material being cut away to expose said second ground plane; and first and second metal blocks each having one cross-sectional dimension equal to the combined thicknesses of said first and second dielectric materials, said first and second dielectric materials having apertures wherein which expose said first and second ground planes, respectively, on either side of and adjacent the printed circuit where said discrete component is connected, said metal blocks being located within said apertures and contacting said ground planes with the exposed surfaces of said first and second dielectric materials in facing relation to one another, said cut away portion of said second dielectric being entirely disposed between said metal bars to form, in conjunction with said first printed circuit conductor, said first dielectric, said metal bars and said ground planes, a microstrip circuit housed within a screened enclosure.

2. A microwave package as recited in claim 1, wherein said discrete component is mounted on said opposite surface of said first printed circuit board and the cut away portion of the second dielectric material provides mechanical clearance for said discrete component.

3. A microwave package according to claim 1, wherein only a portion of said second dielectric material between said metal bars is cut away, the portion of said printed circuit between said metal bars but not underlying said cut away portion of said second dielectric forming the center conductor of a rectangular coax, the outer conductor of which is formed by said metal bars and said ground planes, said rectangular coax and said microstrip circuit having matching impedances.

4. A microwave package according to claim 3, wherein at least a first conductor of said printed circuit underlying said cut away portion of said second dielectric material extends beyond said metal bars, thereby forming, in the order mentioned, a microstrip conductor in the area underlying said cut away portion of said second dielectric material, a rectangular coax center conductor in the area between said metal bars but not underlying said cut away portion, and a stripline center conductor beyond said metal bars, the spacing between said first conductor and said metal bars being controlled to provide impedance matching between said stripline and said rectanglar coax and between said rectangular coax and said microstrip.

5. A microwave package as recited in claim 4, wherein said discrete component is a diode.

6. A microwave package as recited in claim 4, wherein said discrete component is a capacitor.

7. A microwave package as recited in claim 4, wherein said discrete component is a termination.

8. A microwave package according to claim 4, wherein said printed circuit further includes:

a second conductor underlying said cut away portion of said second dielectric material and spaced from said first conductor; and a ground pad spaced from said second conductor and connected to said first continuous ground plane by a plated through hole.

9. A microwave package according to claim 8, wherein said at least one discrete component includes:

means for capacitively coupling said first conductor to said second conductor, and;

a diode connected between said second conductor and said ground pad.

10. A microwave package according to claim 9, wherein said at least first conductor comprises an RF input stripline, said printed circuit further comprising a fourth conductor underlying said cut away portion of said second dielectric material and extending beyond said metal bars to form, in the order mentioned, a microstrip in the area underlying said cut away portion of said second dielectric material, a rectangular coax in the area between said metal bars but not underlying said cut away portion, and a bias input stripline beyond said metal bars, said at least one discrete component further comprising bias decoupling means connected between said fourth conductor and said second conductor and connected between said fourth conductor and said ground pad.

11. A method of fabricating a microwave package which provides symmetrical ground currents when discrete components are used in microwave stripline circuits, comprising:

forming a first printed circuit board of a dielectric material with a ground plane on one surface and a printed circuit on the opposite surface;

forming a second printed circuit board of a dielectric material with a ground plane on one surface only;

cutting slots in the dielectric material of the first printed circuit board to expose the ground plane on either side of and adjacent to the printed circuit;

cutting matching slots in the dielectric material of the second printed circuit board to expose the ground plane and mechanical registry with the slots cut in the dielectric material of the first printed circuit board;

cutting away a portion of the second dielectric material between said matching slots to expose the ground plane of said second printed circuit board;

mounting at lease one discrete component on the printed circuit between said slots;

inserting metal blocks in the slots cut on either side of the printed circuit to contact the ground plane of the first printed circuit board, said metal blocks having one cross-sectional dimension equal to the combined thicknesses of the dielectric materials of said first and second printed circuit boards; and placing said second printed circuit board over said first printed circuit board so that said metal blocks extend through said matching slots and contact the exposed ground plane of said second printed circuit board with the exposed dielectric surfaces of said first and second printed circuit boards in facing relation to one another.

12. The method according to claim 11 further comprising:

affixing metal plates to the ground planes of said first and second printed circuit boards in order to assure continuity of said ground planes.

* * * * *